US006170396B1

(12) United States Patent
Naniwa et al.

(10) Patent No.: US 6,170,396 B1
(45) **Date of Patent: *Jan. 9, 2001**

(54) PRINTING METHOD AND DEVICE FOR MOUNTING PRINTING PLATES VIA COOPERATING HOLES AND PROTRUSIONS

(75) Inventors: Mutsumi Naniwa; Hidefumi Sera, both of Shizuoka (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/246,947

(22) Filed: Feb. 9, 1999

(30) Foreign Application Priority Data

Feb. 13, 1998 (JP) ..... 10-031493

(51) Int. Cl.[7] ..... B41F 27/00; B41N 6/00; B41L 3/02; B41L 3/08

(52) U.S. Cl. ..... 101/382.1; 101/383; 101/401.1; 101/486

(58) Field of Search ..... 101/378, 382.1, 101/383, 384, 395, 401.1, 477, 479, 483, 485, 486

(56) References Cited

FOREIGN PATENT DOCUMENTS 58-1046 1/1983 (JP) .

7-108672 4/1995 (JP) .

*Primary Examiner*—Kimberly Asher
(74) *Attorney, Agent, or Firm*—Sughrue, Mion, Zinn, Macpeak & Seas, PLLC

(57) ABSTRACT

A printing method for performing a lithographic printing in multiple colors by use of a flexible plate material. In particular, a series of engaging holes, while being aligned in the transporting direction of the plate material, are formed for every color in the plate material, and a series of protruded pieces to be inserted into the engaging holes of the plate material, while being aligned in the circumferential direction of each plate cylinder, are formed on the outer peripheral surface of each of the plate cylinders provided for the respective colors, so as to satisfy the following relation:

$$2D \leqq P \leqq 4.06 \times 10^3 \times D/W$$

where

Pmm: pitch of the series of engaging holes (protruded pieces)

Dmm: diameter of each protruded piece

Wmm: width of the printing plate.

The plate material is attached to the plate cylinder by applying the engaging holes of the plate material to the protruded pieces of each plate cylinder, and printing is carried out. Accordingly, a printing method according to the present invention enables a plate material to be reliably held by a plate cylinder while preventing a color misregistration.

5 Claims, 9 Drawing Sheets

PRINTING METHOD AND DEVICE FOR MOUNTING PRINTING PLATES VIA COOPERATING HOLES AND PROTRUSIONS

The present invention relates to a lithographic printing method and device.

BACKGROUND OF THE INVENTION

Generally, the lithographic press prints in such a way that a printing plate is wound on a plate cylinder while being mechanically fastened thereonto. A lithographic printing plate uses a support of a material other than metal (e.g., plastic film, paper or the like), which is easy to handle. However, it is not satisfactory in its dimensional stability. For example, friction between a blanket cylinder and a form plate causes a partial strain resulting in the deformation of the form plate, thereby degrading the printing dimensions and the accuracy of the printing positions relative to a printing paper.

The form plate using a support made of such a material has been used in a limited type of printing, e.g., a simple printing for a small number of prints, which does not require a high registration accuracy. Some modification or alteration needs to be made on the form plate when it is used for standard printing, e.g., high grade printing of multi-color, large scale printing machines or the like.

To cope with this problem, the Japanese Utility Model Unexamined Publication No. Sho. 58-1046 suggested that a plate material should be directly bonded to a preparatory form plate or form cylinder by use of a double-coated adhesive sheet or by use of a spray adhesive of acrylic or rubber material.

This method firmly bonds the printing plate to the plate cylinder. The firm bonding by this method does not allow fine position adjustment of the printing plate on the plate cylinder, and makes it extremely difficult to remove the form plate after printing.

A plate-forming and printing method based on a CTP (computer to plate), which gradually increases its presence in the market, is superior to the conventional plate-forming and printing method (whose exposure step/process for the plate material is based on a close-contact exposure using a lith film), in that the size and position accuracy of an image (exposure) to the plate material is good, and the registration is easy in multi-color printing. However, the lithographic printing plate using the support of a plastic film, a paper or the like, fails to fully utilize the advantage of easy registration in multi-color printing by the CTP because of its disadvantage referred to above.

SUMMARY OF THE INVENTION

Accordingly, an object of the present invention is to provide a printing method using a support of a plastic film, a paper or the like, which has the following advantageous features of: 1) solving the problem of the form plate being partially deformed, thereby degrading the printing dimensions and an accuracy of printing positions relative to a printing paper, 2) enabling the registration to be easy in the multi-color printing in the CTP-basis plate-forming/printing method, and 3) solving the problem of poor working efficiency which is the problem in printing in the conventional printing method.

The above object can be achieved by a printing method, according to a first aspect of the present invention, for performing a lithographic printing in a multiple of colors by use of flexible press plates, in a lithographic printing device including plate cylinders provided for the respective colors wherein each of the plate cylinders includes a series of protruded pieces formed on an outer peripheral surface and aligned in the circumferential direction thereof, the printing method including the steps of:

forming a series of engaging holes on each of the press plates, the engaging holes being aligned in a printing direction in such a manner that the protruded pieces are insertable into the engaging holes;

attaching the press plate to the plate cylinder while the engaging holes of the press plate are engaged with the protruded pieces of each of the plate cylinders; and carrying out the printing, wherein the engaging holes forming step is conducted while a following equation is satisfied:

$$2D \leqq P \leqq 4.06 \times 10^3 \times D/W$$

where P defines at least one of a pitch of the series of engaging holes in the printing direction and a pitch of the series of protruded pieces in the circumferential direction, D indicates a diameter of each protruded piece, and W denotes a width of the press plate.

In the above-mentioned printing method, it is preferable that the printing step is conducted while rotating the plate cylinder in a state that the engaging holes of the press plate are being engaged with the protruded pieces.

In the above-mentioned printing method, it is advantageous that the lithographic printing device further includes an exposure drum which has a series of protruded pieces formed on and along the outer circumferential surface thereof so as to be inserted into the engaging holes, and the printing method further includes the steps of:

attaching the press plate to the exposure drum while the engaging holes of the press plate are engaged with the protruded pieces of the exposure drum; and exposing the press plate.

In addition, the above-mentioned object can also be attained by a printing method, according to a second aspect of the present invention, for performing a lithographic printing in a multiple of colors by use of flexible press plates, in a lithographic printing device including plate cylinders provided for the respective colors, wherein each of the plate cylinders includes a series of protruded pieces formed on an outer peripheral surface and aligned in the circumferential direction thereof, the printing method including the steps of:

drawing out a press plate in the form of a roll which is stored in a form-plate forming device;

cutting the press plate thus drawn out to form a sheet-like press plate;

forming a series of engaging holes on each of the press plates, the engaging holes being aligned in a printing direction;

attaching the plate material to the plate cylinder while the engaging holes of the press plate are engaged with the protruded pieces of each the plate cylinder; and carrying out the printing.

In the above-mentioned printing method, it is preferable that the lithographic printing device further comprises an exposure drum which has series of protruded pieces formed on and along the outer circumferential surface thereof so as to be inserted into the engaging holes of the press plate, and the printing method further includes the steps of:

attaching the press plate to the exposure drum while the engaging holes of the press plate are engaged with the protruded pieces of the exposure drum; and exposing the press plate.

Further, in the above-mentioned printing method, it is advantageous that a pitch of the series of engaging holes in the printing direction is determined so as to satisfy the following equation:

$$2D \leqq P \leqq 4.06\times10^3\times D/W$$

where P defines a pitch of the series of engaging holes in the printing direction, D indicates a diameter of each protruded piece, and W denotes a width of the press plate.

Further, the above-mentioned object can also be attained by a lithographic printing device, according to a third aspect of the present invention, including:

a plurality of plate cylinders provided for the respective colors;

a plurality of packing sheet respectively attached to the plate cylinder and each including a series of protruded pieces aligned in a circumferential direction of the respective plate cylinder, wherein the plate having engaging holes is conveyed in a printing direction while the engaging holes are brought into engagement with the protruded pieces, and the protruded pieces satisfy a following equation:

$$2D \leqq P \leqq 4.06\times10^3\times D/W$$

where P defines a pitch of the series of protruded pieces in the circumferential direction, D indicates a diameter of each protruded piece, and W denotes a width of a press plate.

In the printing method according to the first aspect of the present invention, a strength of the area of the plate material located between the adjacent engaging holes is satisfactory, and durable for a load acting on one engaging hole.

When the pitch of the protruded pieces series is shorter than 2D, that strength is insufficient, and when that pitch is longer than $4.06\times10^3\times D/W$, the load acting on one engaging hole is large, so that a deformation amount of one engaging hole exceeds a tolerable value of a deformation amount. Therefore, to secure a reliable holding of the plate material by the plate cylinder, the following relationship needs to be satisfied:

$$2D \leqq P \leqq 4.06\times10^3\times D/W.$$

In the printing method according to the second aspect of the present invention, the cutting of a rolled plate material and the formation of engaging holes in the plate material are concurrently or successively carried out. This leads to improvement in working efficiency. Further, the exposure and printing processes are carried out using the same positioning reference holes. This leads to the ease of color registration in the multi-color printing.

In the printing method above, when the lithographic printing device further includes an exposure drum which has a series of protruded pieces formed on and along the outer circumferential surface thereof so as to be inserted into the engaging holes of the plate material, the dimensions of the plate material and the image dimensions relative to the plate material, and the positioning accuracy when the exposure process is carried out, may be exactly the same as those when the printing is carried out. This feature provides a considerably exact registration of colors.

With the packing sheet according to the third aspect of the present invention, there is no need for working the plate cylinder in any way. Therefore, easy color registration is made at low cost.

Note that Japanese Patent Unexamined Publication No. Hei-7-108672 teaches that a series of protruded pieces are formed on and along the outer circumferential surface of a plate cylinder of a gravure printing press. Engaging holes of the plate material are applied to the protruded pieces of the plate cylinder, to thereby position the plate material to the plate cylinder. The engaging holes and the protruded pieces are used for causing the plate cylinder to hold the plate material in a tension state. Therefore, the disclosed technique is not concerned with a technique to firmly hold the plate material without any shift even under high printing pressure as in offset printing. No description on an implant pitch of the protruded pieces series is found in the publication. The technique of the publication is directed to the sheet-like plate material after cut, and hence is not relevant to the rolled plate material.

DETAILED DESCRIPTION OF THE PREFERRED EMBODIMENTS

Figure 1:
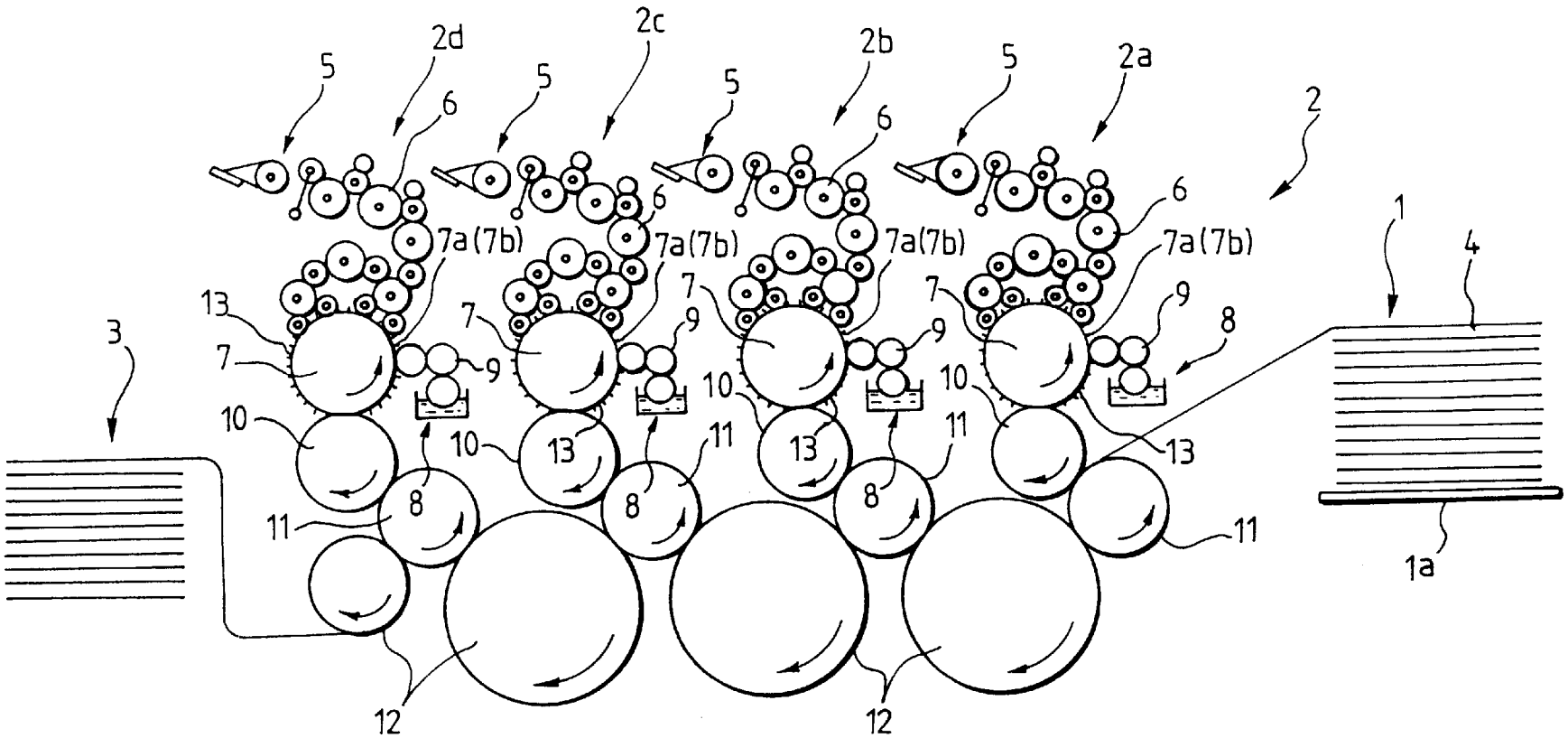
FIG. 1 schematically illustrates a multi-color lithographic press which is one embodiment of the present invention.

FIG. 1 schematically illustrates a multi-color lithographic press which is one embodiment of the present invention. As shown, the multi-color lithographic press is generally made up of a paper-feed section 1, a printing section 2, a paper discharging section 3. A stack of printing papers 4 that are put in a pallet la in the paper-feed section 1 are fed, sheet by sheet, to printing units 2*a*, 2*b*, 2*c* and 2*d* in the printing section 2. Those printing units are provided for color printing of four colors, black, cyan, magenta and yellow. In each of the printing units 2*a*, 2*b*, 2*c* and 2*d*, ink is supplied from an ink device 5 to a printing image area on a plate material (so called as a press plate or a machine plate) 13 that is placed on a plate cylinder 7, by way of an ink roll 6. Water is supplied from a wetting device (so called as a dampening system) 8 to the plate material 13 by way of wetting rollers (so called as dampening form rollers) 9 to coat a non-printing-image area on the plate material 13 with the supplied water (so called as a fountain solution). Ink on the image area on the plate material 13 is transferred to a rubber cylinder 10 and an image of the image area is transferred onto a printing paper 4 passing through the nip between the rubber cylinder 10 and a pressure cylinder 11. After one printing unit completes the printing of the image on the printing paper 4, the printing paper 4 bearing the printed image thereon is transported to the subsequent printing unit by a paper transporting cylinder 12. The printing and transferring operations are successively repeated, and when the printing unit 2*d* completes the printing operation, the printing of one sheet of printing paper by the printing section 2 is completed, and the printing paper having a picture printed thereon is transported to the paper discharging section 3.

Series of protruded pieces 7*a* and 7*b* are respectively aligned on and along the right and left ends (when longitudinally viewed) of the outer circumferential surface of the plate cylinder 7 in the multi-color lithographic press under discussion. In the embodiment, the pitch of each of the series of the protruded pieces 7*a* and 7*b* (=pitch of each of series of engaging holes 14*a* and 14*b* of the plate material 13) is P mm; the diameter of each of the protruded pieces 7*a* and 7*b* (in other words, the diameter of each of the engaging holes 14*a* and 14*b*) is D mm; and the width of the form plate is W mm. Those dimensions are defined by $$2D \leqq P \leqq 4.06 \times 10^3 \times D/W.$$

For example, in the plate material 13 of PET or WP (photographic paper) of 0.188 mm (thick)×730 mm (wide)×600 mm (long), if the pitch P of the protruded pieces 7*a* and 7*b* is shorter than 2D, a strength of the area of the plate material 13, located between the adjacent engaging holes 14*a* and 14*a* (14*b* and 14*b*), is unsatisfactory; and if the pitch P of the protruded pieces 7*a* and 7*b* is longer than $4.06 \times 10^3 \times D/W$, a load applied to one of series of engaging holes 14*a* and 14*b* causes an amount of deformation of the plate material 13 to be in excess of a tolerable value of deformation amount.

Figure 3:
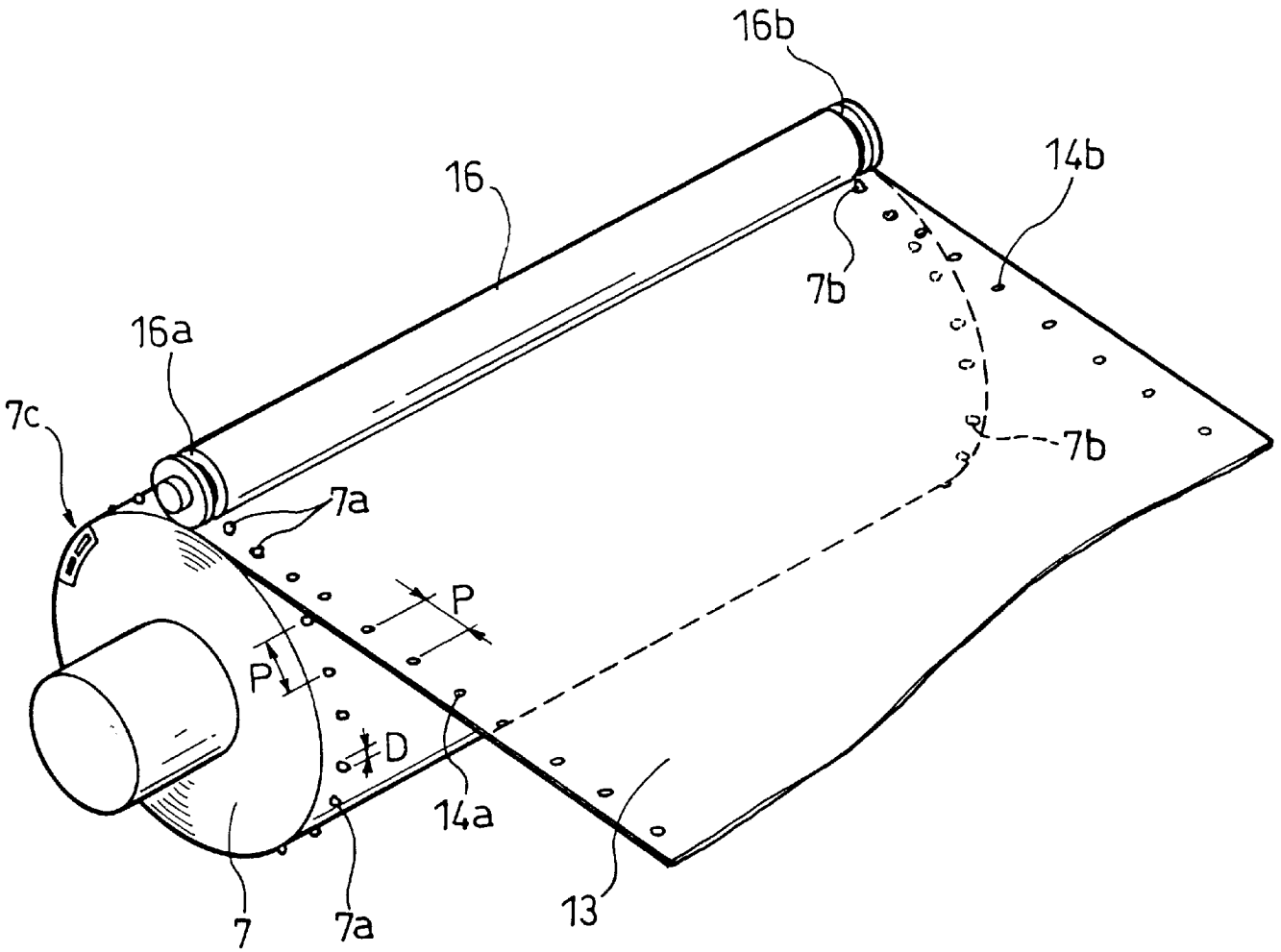
FIG. 3 is a perspective view schematically showing how to attach the plate material to a plate cylinder.

As shown in FIG. 3, in order to set the plate material 13 to the plate cylinder 7, the fore end of the plate material 13 is brought into engagement with pawls 7*c* of the plate cylinder 7, and in this state, the plate material 13 is applied onto the plate cylinder 7, while turning the plate cylinder 7, so as to successively insert the protruded pieces 7*a* and 7*b* of the plate cylinder 7 into the engaging holes 14*a* and 14*b* of the plate material 13. When the plate material 13 is installed/mounted to the plate cylinder 7, the following procedure is carried out: the protruded pieces 7*a* and 7*b* of the plate cylinder 7 are successively fitted into grooves 16*a* and 16*b*, which are formed around both ends of a form-plate attaching roll 16 attached to the plate cylinder 7; and the edges of the form-plate attaching roll 16, which define the grooves 16*a* and 16*b*, press the circumferences of the engaging holes 14*a* and 14*b* of the plate material 13 to apply the engaging holes 14*a* and 14*b* to the protruded pieces 7*a* and 7*b*.

Figure 4:
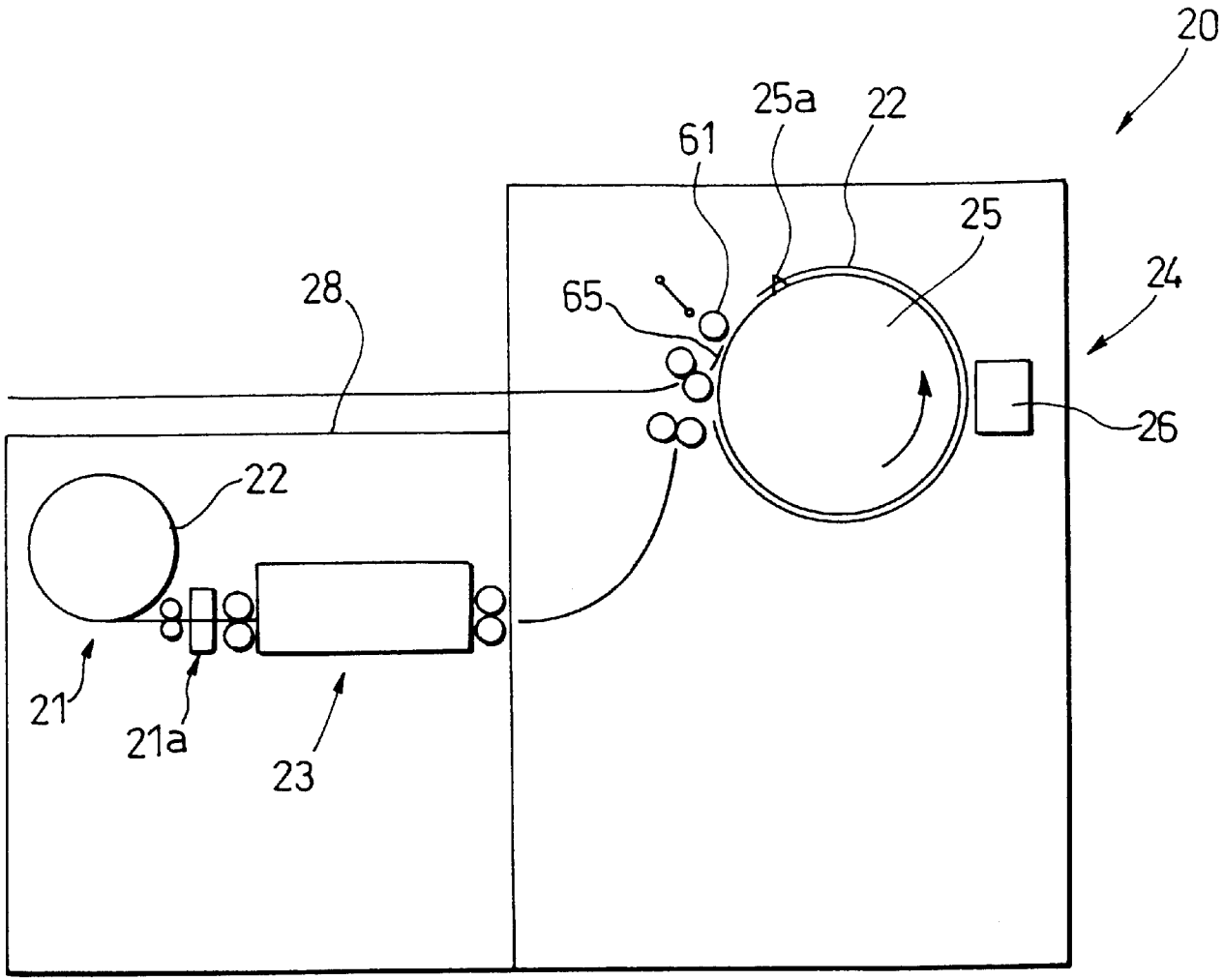
FIG. 4 is a schematic illustration of a form-plate forming device for the FIG. 2 plate material.
Figure 5:
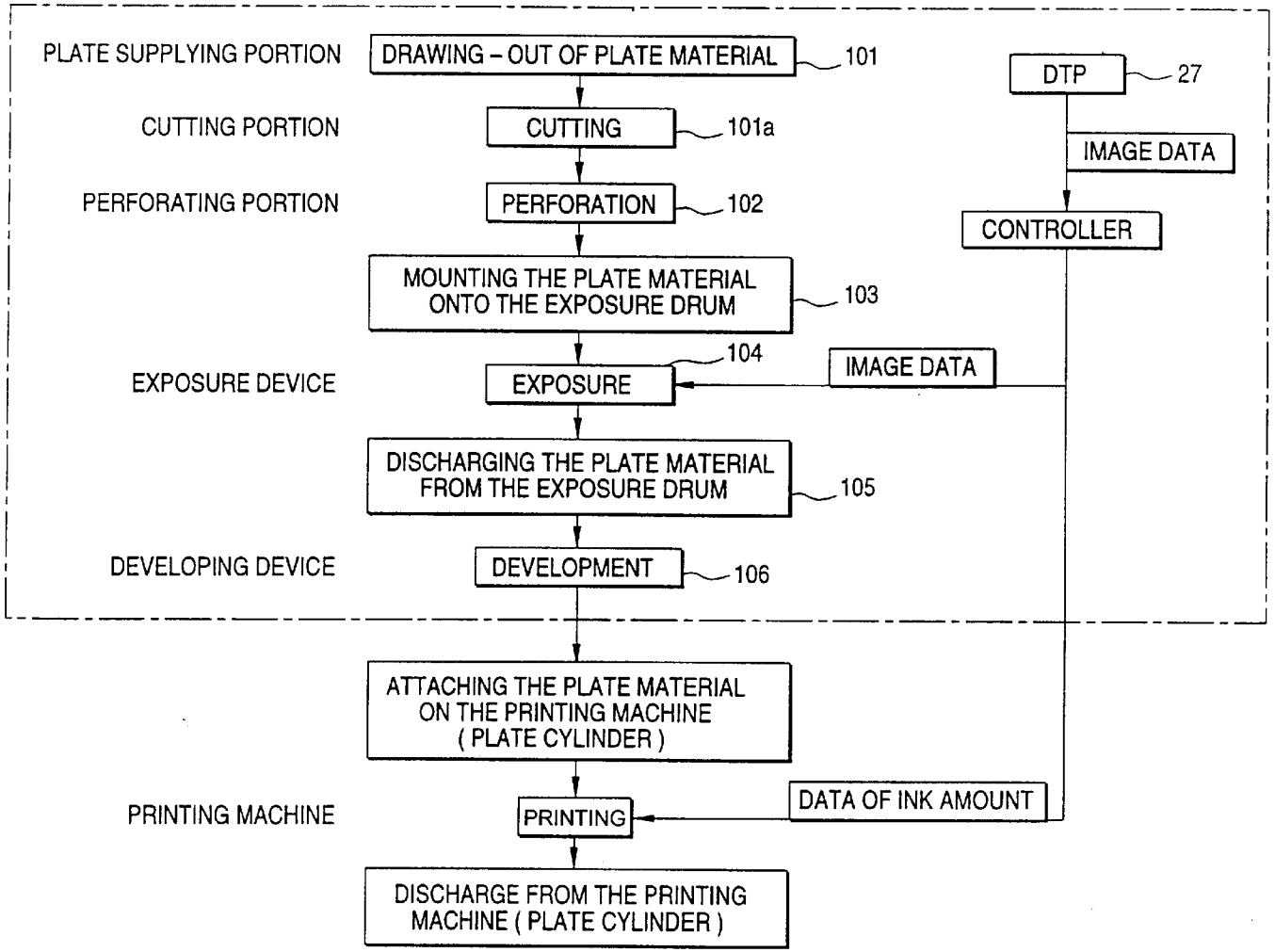
FIG. 5 is a flow chart showing a flow of the operations of the FIG. 4 form-plate forming device.

FIG. 4 schematically illustrates a form-plate forming device so called as a plate making device) 20 for the plate material 13, and FIG. 5 shows a flow chart of a flow of form-plate forming processes. A form-plate forming device 20 operates in the following way.

Step 101: A plate material 22 consisting of a roll-like photosensitive member, which is accommodated in a printing (photosensitive) accommodating portion 21, is taken/drawn out of the printing accommodating portion 21.

Step 101*a*: The plate material 22 is cut to have a desired size by a cutting means 21*a*.

Step 102: The plate material 22 is punched by a punching unit 23 to have a series of engaging holes 14*a* and 14*b* on and along both ends of the plate material 22.

Step 103: The plate material 22 is conveyed to an exposure drum 25 of an exposure section 24; engaging holes 15*a* and 15*b* that are formed in the fore end of the printing plate (FIG. 2) are respectively applied to a set of exposure-reference pins 25*a* and 25*a* of the exposure drum 25, to thereby effect positioning of the printing plate; and it is fixed to the exposure drum by known suitable fixing means, clamping, vacuum or the like.

Step 104: The plate material 22 is rotated with a rotation of the exposure drum 25, and passes by a laser device 26 for outputting optical images, which is coupled for reception with a DTP (desk top publishing) device 27 for outputting image data. At that time, an image is depicted on the surface of the plate material 22 by a laser beam output from the laser device 26 after it is modulated by the image data output from the DTP device 27.

Step 105: The plate material 22 bearing the image depicted thereon is stripped off from the exposure drum 25.

Step 106: The image on the plate material 22 is developed, and the plate material 22 bearing the developed image or picture is discharged onto a printing-plate receiving table 28.

The exposing method and the developing method, which are employed in the embodiment, may properly be selected from among the known ones.

Figure 6:
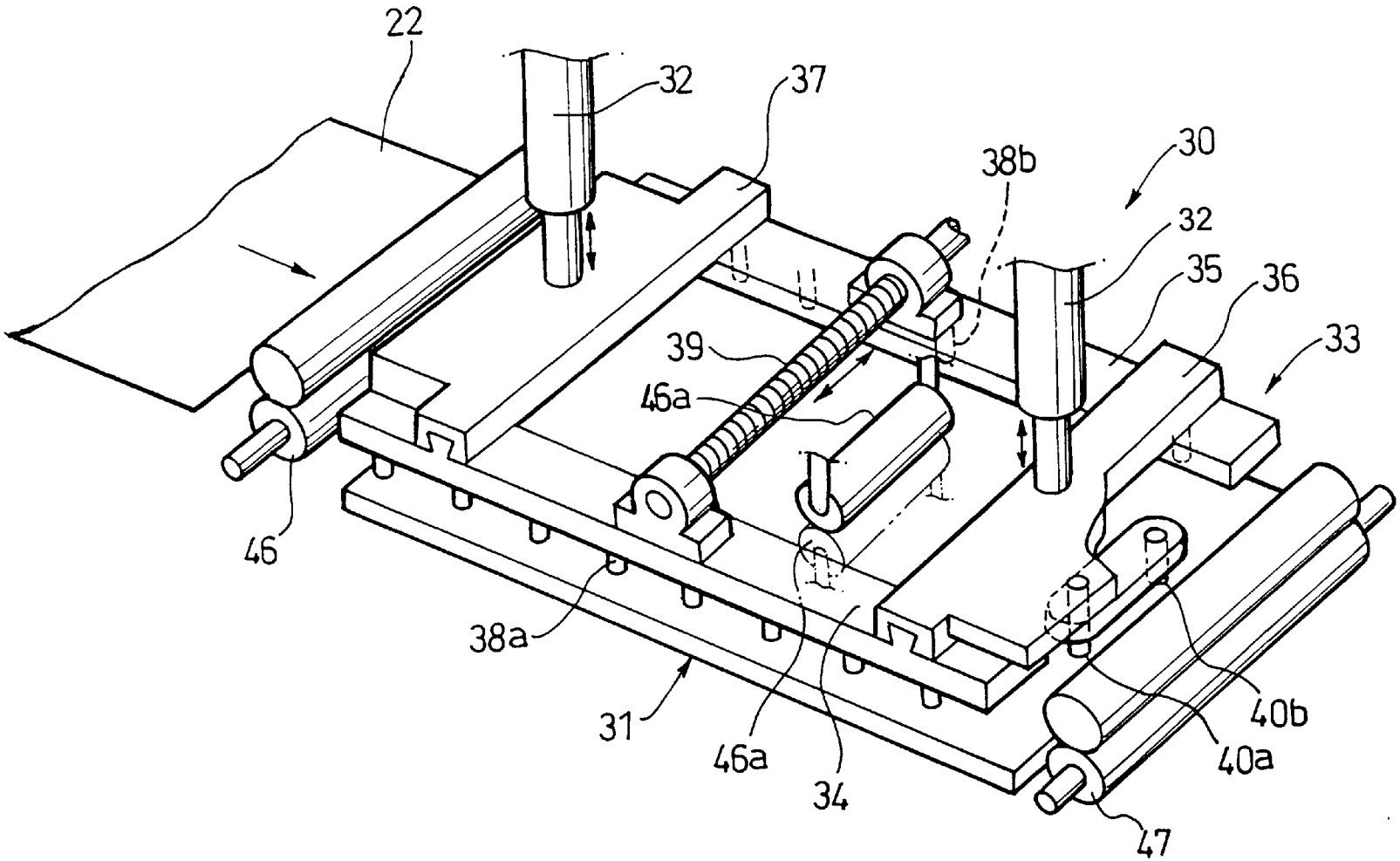
FIG. 6 is a perspective view schematically showing a punching device incorporated into a punching unit of the form-plate forming device of FIG. 4.

FIG. 6 shows a perspective view of a punching device 30, which may be used as the punching unit 23 in the form-plate forming device 20. The punching device 30 is disposed in the transporting path of the plate material 22, and generally comprises a plate-receiving table 31 forming the transporting path and a frame assembly 33 which is disposed above the plate-receiving table 31 and vertically moved by a couple of hydraulic cylinders 32. The frame assembly 33 includes right and left frames 34 and 35. Those frames are jointed to a couple of guide rails 36 and 37 in a dovetail fashion, and maybe put on and pulled out of the plate-receiving table 31. A series of pins 38*a* and 38*b* are protruded from or planted in the underside of the frames 34 and 35, while being equidistantly aligned in the longitudinal direction of the frames at a predetermined interval.

Figure 2:
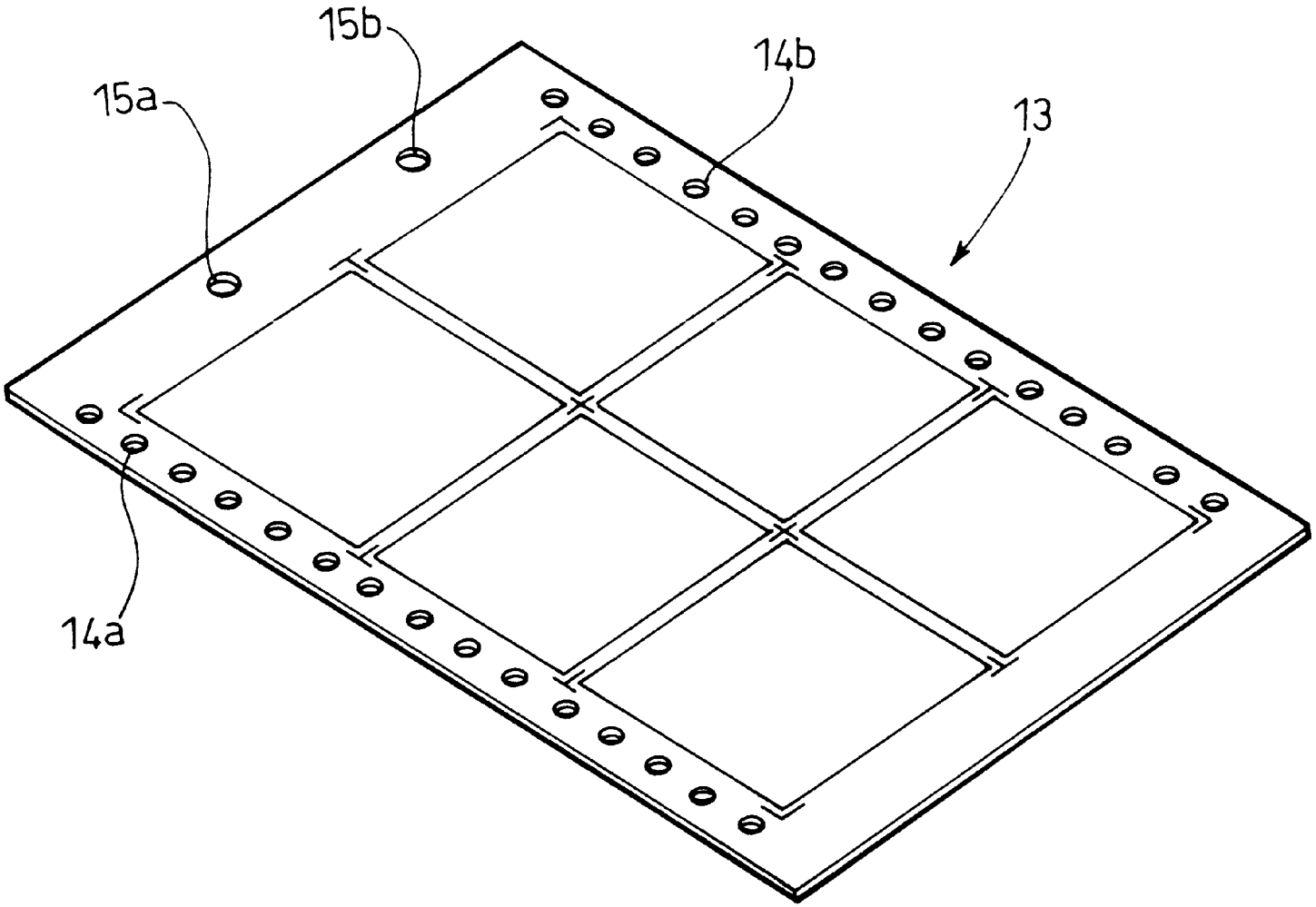
FIG. 2 is a perspective view schematically showing a plate material used in the multi-color lithographic press of FIG. 1.

Those series of pins 38*a* and 38*b* punch a series of engaging holes 14*a* and 14*b* of the printing plate of the plate material 13 (FIG. 2). A threaded bar (screw shaft) 39 is provided between the frames 34 and 35 such that one of the frames is rotatably mounted on the corresponding frame while the other is screwed into the corresponding frame, in such a manner that a distance between the frames 34 and 35 is adjustable by turning the threaded bar 39.

A first transporting roll pair 46, a second transporting roll pair 46*a* and a third transporting roll pair 47 are located at and along the rear end, the middle and the front end of the plate-receiving table 31, respectively.

In the punching unit 23 provided with the thus constructed punching device 30, in an initial stage of the plate forming, the frames 34 and 35 are made to ascend by the hydraulic cylinders 32, and the paired transporting rolls 46*a* are in contact with each other or brought together by a hydraulic cylinder (not shown).

In this state, the plate material 22 emanates from the first transporting roll pair 46; reaches the plate-receiving table 31, is nipped between the paired transporting rolls 46*a*; and is stopped and positioned at a fixed position by means of a positioning means (not shown). A hydraulic cylinder (not shown) operates to move the paired second transporting rolls 46*a* apart from each other; the hydraulic cylinders 32 operate to make the frames 34 and 35 descend; and the series of pins 38*a* and 38*b* of the underside of the frames punch engaging holes 14*a* and 14*b* of the plate material 22 (plate material 13). Following the punching operation, the hydraulic cylinders 32 are operated; the paired transporting rolls 46*a* come in contact with each other and the paired third transporting rolls 47 also come in contact with each other; and the plate material 22 is transported forward to the exposure drum 25 by those transporting roll pairs (FIG. 4).

As described above, the punching device 30 is constructed such that the first to third transporting roll pairs 46, 46*a* and 47 are located at and along the rear end, the middle and the fore end of the plate- receiving table 31, and the plate material 22 is fed into the plate- receiving table 31, and discharged therefrom.

The first to third transporting roll pairs 46, 46*a* and 47 may be omitted if a belt conveyor is used in place of the plate-receiving table 31. In addition, The first to third transporting roll pairs 46, 46*a* and 47 may be omitted, if the plate-receiving table 31 is disposed at the punching position while belt conveyors are laid in the regions except the punching position.

Further, if desired, at the time of punching, the plate material 22 may be fixed to the plate-receiving table 31 by suitable means, e.g., vacuum means.

Plural sets of exposure-reference pins 25*a* may be provided corresponding to the plates of different sizes (i.e., widths) to be used. In this case, the exposure-reference pins 25*a* are so designed that only the set of exposure-reference pins for the printing plate being processed for its forming are protruded, while the remaining sets of exposure-reference pins are retracted.

The exposure-reference pins 25*a* may be formed at other positions than those corresponding to the engaging holes. In the punching device 30 of FIG. 4, the exposure-reference pins 25*a* are provided at positions corresponding to the exposure-reference holes on the printing plate (FIG. 2). Specifically, exposure-reference pins 40*a* and 40*b* are provided on the guide rail 36.

Thus, the engaging holes 14*a* and 14*b* of the plate material 13 are successively applied to the protruded pieces 7*a* and 7*b* of the plate cylinder 7, whereby the plate material 13 is held by the plate cylinder 7. If a plate holding mechanism 50 constructed as shown in FIG. 7 is used, the holding of the plate material 13 by the plate cylinder 7 is more reliable.

Figure 7:
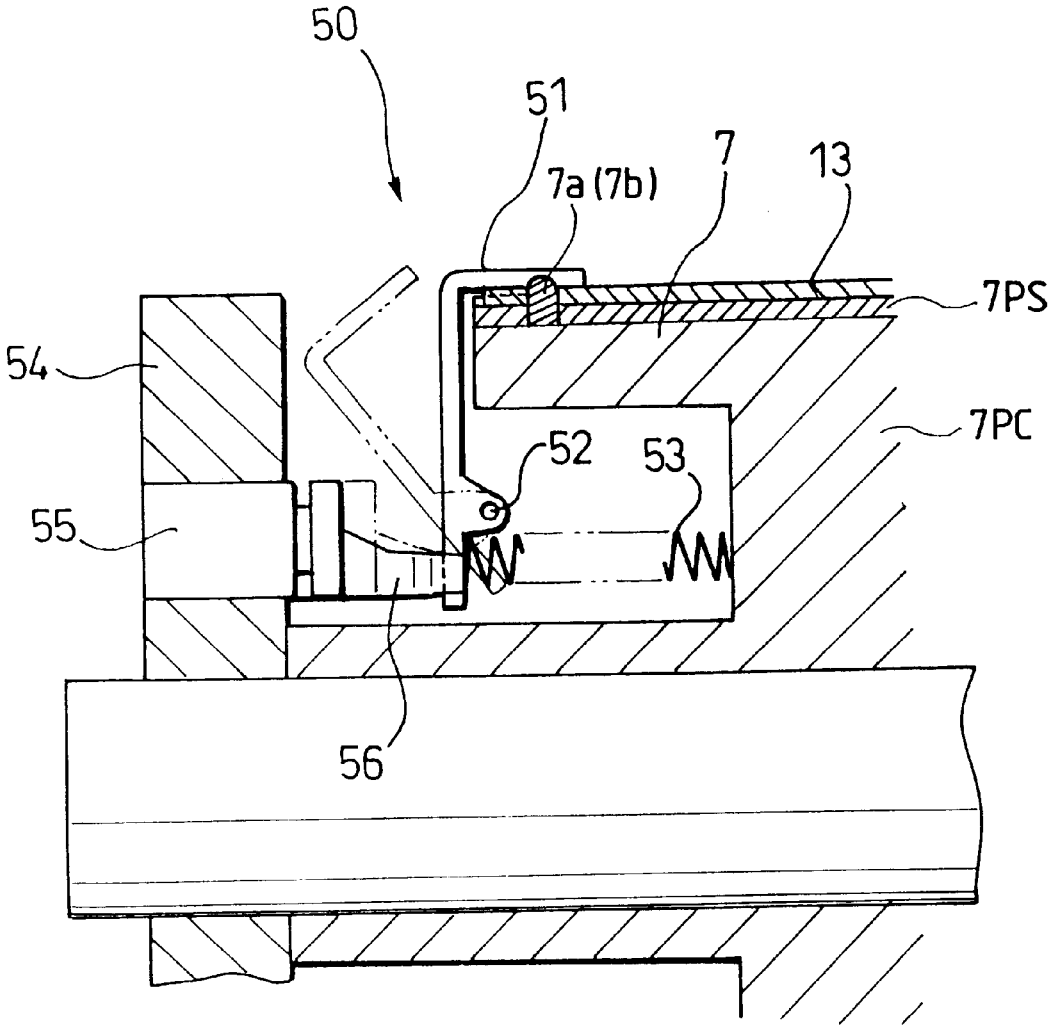
FIG. 7 is a cross sectional view showing a plate holding mechanism for holding a plate material formed by the FIG. 4 form-plate forming device on and by the printing plate.
Figure 9:
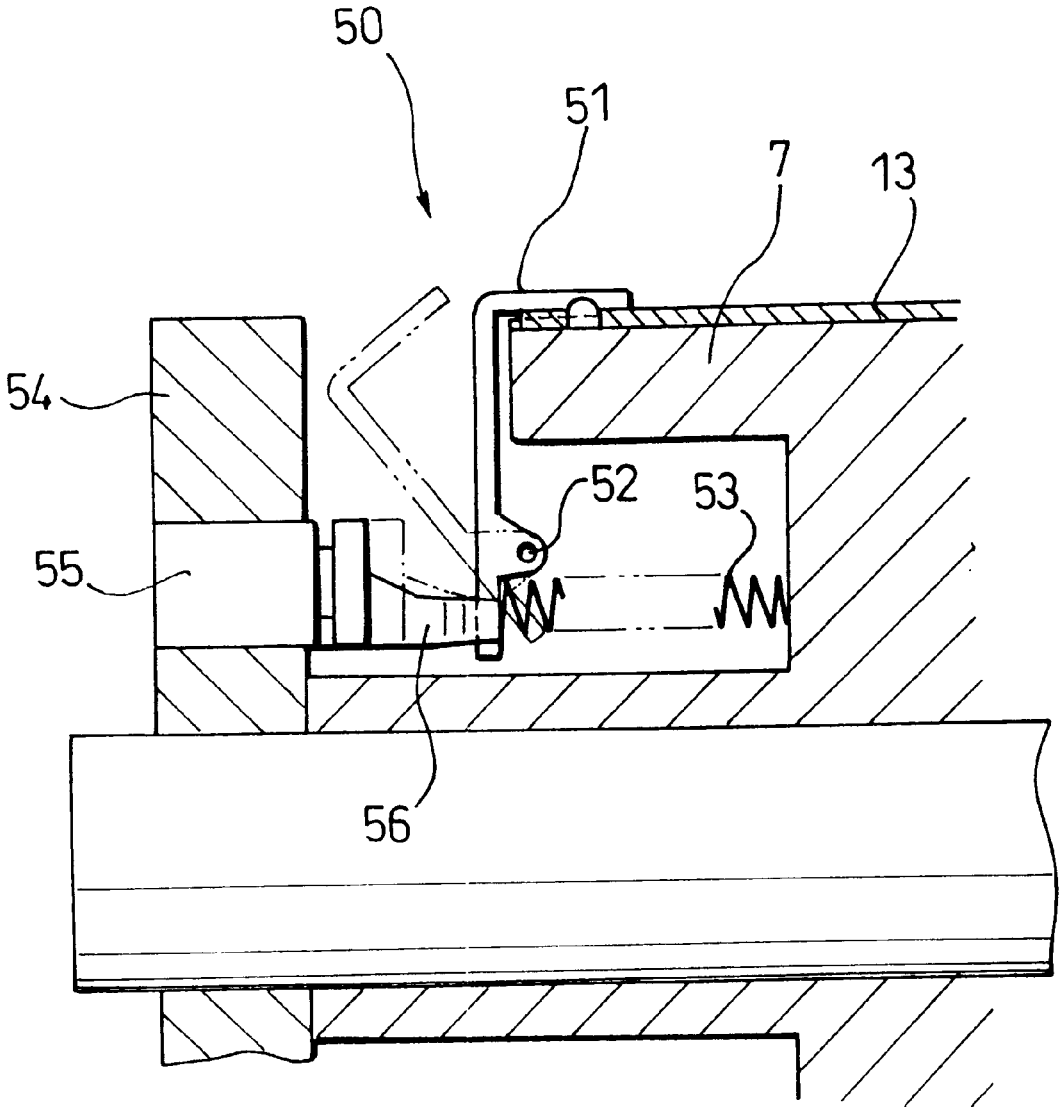
FIG. 9 is a cross sectional view of a modified plate cylinder which does not have a packing sheet.

Note that in this embodiment as shown in FIG. 7, the plate cylinder 7 comprises a plate cylinder member 7PC having a flat peripheral surface and a packing sheet 7PS on which the protruded pieces 7*a* and 7*b* and which is attached or implanted to the plate peripheral surface of the plate cylinder member 7PC. However, it is possible to form the protruded pieces 7*a* and 7*b* directly on the plate cylinder member 7PC, as shown in FIG. 9.

A description of the plate holding mechanism 50 follows. A series of pawls 51 are provided on both ends of the plate cylinder 7. The base end of each pawl 51 is rotatably supported by a shaft 52. A spring 53 urges the tip of the pawl 51 toward the corresponding end of the plate cylinder 7. A hydraulic cylinder 55 is provided in a bearing housing 54 of the plate cylinder 7. A cam 56 is firmly attached to the tip of the rod of the hydraulic cylinder 55, while being confronted with the pawl 51.

When the plate material 13 is wound on the plate cylinder 7, the hydraulic cylinder 55 is operated to move the cam 56 forward. When the pawl 51 advances along the cam 56, the pawl 51 is turned apart from the end of the plate cylinder 7 while resisting the urging force of the spring 53. Therefore, the plate cylinder 7 maybe wound on the plate cylinder 7 without any interruption by the pawls 51.

Figure 8:
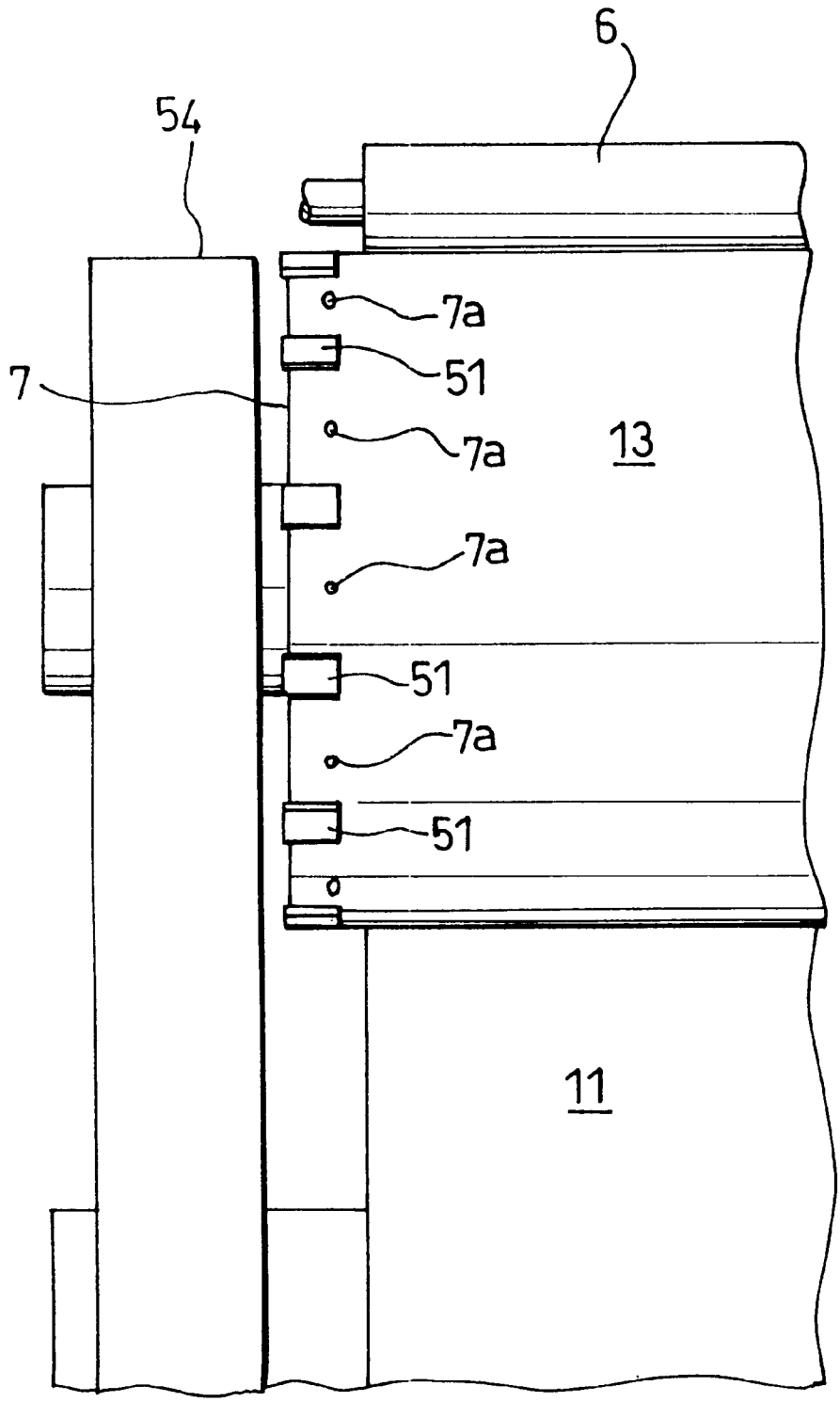
FIG. 8 is a partial front view showing a state that the plate material is applied to and held by the plate cylinder by use of the FIG. 7 plate holding mechanism.

When the pawls 51 moves with the cams 56, the pawls 51 are turned by the spring 53 to face both ends of the plate cylinder 7. At this time, the pawls 51 are each located between the adjacent protruded pieces 7*a* and cooperate with the plate cylinder 7 to hold the plate material 13 therebetween (FIG. 8). Then, the hydraulic cylinder 55 is operated to retract the cams 56. In the plate holding mechanism 50 described above, the springs 53 and the cams 56 make up actuators of the pawls 51. Alternatively, the hydraulic cylinder 55 is assembled into the plate cylinder 7, and directly drives the pawls 51.

Thus, the plate material 13 attached onto the plate cylinder 7 is disposed in contact with a rubber roll 11 and an inking roll 6 (FIG. 8). In this state, the pawls 51 are positioned without any interruption with the rubber roll 11 and the inking roll 6.

As described above, the plate material 13 is formed in the plate forming procedure mentioned above by use of the form-plate forming device 20 (FIG. 4). The thus formed plate material 13 is wound on the plate cylinder 7 of the lithographic printing press and subjected to a printing process.

In the above-mentioned embodiment, the (offset printing) lithographic press is separated from the plate forming device. If required, the plate forming device may be incorporated into the (offset printing) lithographic press. In this case, the plate forming process and the printing process are carried out in a successive manner.

In the construction of the form-plate forming device 20, the punching unit 23 and the exposure section 24 may be separated from each other, or combined into a unit. form.

EXAMPLE DESCRIPTION

Example 1

Some examples were manufactured and subjected to tests. In this case, metal plates, as one example of the packing sheet according to the present invention, having a series of protruded pieces were attached to a conventional plate cylinder, because a large cost was required to additionally form the series of protruded pieces on the conventional plate cylinder of the printing press.

A substrate which is utilized for forming the metal plate having a series of protruded pieces formed thereon, was a stainless steel plate of 0.2 mm thick. A DIAYA 1F offset rotary press (referred to as a printing press), manufactured by MITSUBISHI HEAVY INDUSTRY corporation, was used for tests. A standard printing plate for the printing press was 600 mm long (in the printing direction)×730 mm wide, so that a substrate 600 mm long in the printing direction, equal to the standard printing plate of the printing press, and 746 mm wide, was used. The width of the substrate was slightly wider than that of the standard printing plate in order to secure a space for forming the protruded pieces.

A series of attaching holes each having a diameter of 4.5 mm and being provided at the substantially same interval as the engaging holes of the printing plate, were formed in and along both ends of the stainless steel plate, and properly cut. Four stainless steel plates were formed of which the series of attaching holes are aligned at different pitches P, 37.5 mm ($6.08\times10^3\times D/W$), 25 mm ($4.06\times10^3\times D/W$), 12.5 mm ($2.03\times10^3\times D/W$), and 9 mm (2D).

Pins made of stainless steel were bonded, by epoxy adhesive, on the series of attaching holes of the stainless steel plate. The diameter of each of the pins was 4.5 mm, and the height of protrusion after it was bonded was 2 mm.

Thus, the metal plates (that is, the packing sheets) having the series of attaching protruded pieces, were manufactured.

Those protruded pieces of the metal plates were positioned so as not to interfere with various plate cylinders, the rubber cylinder, inking roller, wetting roller and the like, when the metal plates are wound on the plate cylinder.

A printing plate was cut to have the following dimensions: the length of it when viewed in the printing direction was 580 mm, slightly shorter than that of the standard printing plate (i.e., 600 mm) for the above-mentioned printing press (DIAYA 1F offset rotary press (referred to as a printing press), manufactured by MITSUBISHI HEAVY INDUSTRY corporation), and the width of it was 746 mm, slightly wider than that of the standard printing plate (i.e., 730 mm), in order to secure the space for forming a series of engaging holes at and along both ends thereof.

A series of engaging holes each having the diameter of 4.5 mm were formed in and along both ends of the printing plate when viewed in the widthwise direction. Four printing plates were formed, of which the series of engaging holes were aligned at different pitches P, 37.5 mm ($6.08\times10^3\times D/W$), 25 mm ($4.06\times10^3\times D/W$), 12.5 mm ($2.03\times10^3\times D/W$), and 9 mm (2D), so that those engaging holes printing plates match in pitch the protruded pieces series of the metal plates.

Those four plate materials were subjected to an exposure process and plate forming process by use of the form-plate forming device, whereby one of two two-color printing plates was formed.

Further, a plate material having an aluminum support was subjected to an exposure process and a plate forming process by use of the form-plate forming device, whereby the other of the two two-color printing plates was formed.

The aluminum-support printing plate, or the second printing plate, was attached to the first unit of the above-mentioned printing press (DIAYA 1F offset rotary press (referred to as a printing press), manufactured by MITSUBISHI HEAVY INDUSTRY corporation) in the usual manner. The printing plate with the series of engaging holes, or the first printing plate, was attached to the second unit of the printing press by use of the metal plate with the protruded pieces. To be more specific, the first printing plate having the engaging holes was positioned to the metal plate having the protruded pieces so that the front end of the former was coincident with the front end of the latter. In this state, the protruded pieces of the metal plate were inserted into the engaging holes of the first printing plate. The front ends of the metal plate and the first printing plate were fixed by a head vise, while the rear end of the metal plate was fixed by a tail vise. Accordingly, the tail or rear end of the first printing plate was free.

A two-color printing was carried out by the printing press thus set, using the printing plates and the metal plates. A registration of the image was initially coincided, and then the printing of 500 number of printing (the printing of a half-thousand prints) was carried out. After that, those printed pictures were visually evaluated on their misregistration by ten evaluators. The evaluation results are tabulated in Table 1.

TABLE 1

| Sample No. | Pitch (mm) (engaging hole/ protruded piece) | | Evaluation of Mis-registration |
|---|---|---|---|
| 1 | 37.5 | $6.08\times10^3\times D/W$ | x |
| 2 | 25 | $4.06\times10^3\times D/W$ | Δ |
| 3 | 12.5 | $2.03\times10^3\times D/W$ | ○ |
| 4 | 9 | 2D | ○ |

Printing press: DAIYA 1F (MITSUBISHI HEAVY INDUSTRY corporation)
Printing plate width: 700 mm
Diameter of each protruded piece: D = 4.5 mm The evaluation of misregistration:

○: ten evaluators all evaluated that no picture quality deterioration arising from misregistration was present.

Δ: seven to eight evaluators evaluated that no picture quality deterioration was present. No problem in practical use.

×: a six or smaller number of evaluators evaluated that no picture quality deterioration was present. The printed pictures were at an impractical level.

The test results showed that when the pitch of the engaging holes (protruded pieces) is 25 mm ($4.06\times10^3\times D/W$), the misregistration is at a practical level, and a distortion (expansion) of the form plate is effectively reduced; and further that when it is 12.5 mm ($2.03\times10^3\times D/W$), no problem arises in practical use.

Example 2

A printing press used in Example 2 was the DIAYA 1F offset rotary press, manufactured by MITSUBISHI HEAVY INDUSTRY corporation, as in Example 1. The material and size of a metal plate, as an example of a packing sheet according to the present invention, having protruded pieces, were substantially the same as that of the metal plate used in Example 1: a stainless steel sheet of 0.2 mm thick was used, and it was cut to achieve a metal sheet of 600 mm long (in the printing direction) and 746 mm wide.

A series of attaching holes each having the diameter of 3 mm were formed in and along both ends of the stainless plate when viewed in the widthwise direction. Those attaching holes were provided at substantially the same interval as the engaging holes of the printing plate. Four stainless steel plates were formed of which the series of attaching holes were aligned at different pitches P, 25 mm ($6.08\times10^3\times D/W$), 16.7 mm ($4.06\times10^3\times D/W$), 8.3 mm ($2.03\times10^3\times D/W$), and 6 mm (2D).

Pins made of stainless steel were bonded, by epoxy adhesive, on the series of attaching holes of the stainless steel plate. The diameter of each of the pins was 3 mm, and the height of it after it was bonded was 2 mm.

Thus, metal plates having a series of protruded pieces were manufactured.

A printing plate was cut to be 580 mm long (in the printing direction) and 746 mm wide, as in Example 1.

A series of engaging holes each having the diameter of 3 mm was formed in and along both ends of the printing plate when viewed in the widthwise direction. Four printing plates were formed of which the series of engaging holes are aligned at different pitches P, 25 mm ($6.08\times10^3\times D/W$), 16.7 mm ($4.06\times10^3\times D/W$), 8.3 mm ($2.03\times10^3\times D/W$), and 6 mm (2D) so that those engaging holes printing plates match in pitch the protruded pieces series of the metal plates. The exposure, plate-forming, printing and evaluations of the resultant prints were carried out as in the procedure of Example 1. The results are tabulated in Table 2.

TABLE 2

| Sample No. | Pitch (mm) (engaging hole/ protruded piece) | | Evaluation of Mis-registration |
|---|---|---|---|
| 1 | 25 | $6.08 \times 10^3 \times D/W$ | x |
| 2 | 16.7 | $4.06 \times 10^3 \times D/W$ | Δ |
| 3 | 8.3 | $2.03 \times 10^3 \times D/W$ | ○ |
| 4 | 6 | 2D | ○ |

Printing press: DAIYA 1F (MITSUBISHI HEAVY INDUSTRY corporation)
Printing plate width: 730 mm
Diameter of each protruded piece: D = 3 mm The evaluation of misregistration:

○: ten evaluators all evaluated that no picture quality deterioration arising from misregistration was present.

Δ: seven to eight evaluators evaluated that no picture quality deterioration was present. No problem in practical use.

×: a six or smaller number of evaluators evaluated that no picture quality deterioration was present. The printed pictures were at an impractical level.

The test results show that when the pitch of the engaging holes (protruded pieces) is 16.7 mm ($4.06\times10^3\times D/W$), the misregistration is at a practical level, and a distortion (expansion) of the form plate is effectively reduced, and further, that when it is 8.3 mm ($2.03\times10^3\times D/W$), no problem arises in practical use.

Example 3

The printing press used in Example 3 was the DIAYA 1F offset rotary press, manufactured by MITSUBISHI HEAVY INDUSTRY corporation, as in Examples 1 and 2. A support used for the metal plate, as an example of the packing sheet, having protruded pieces formed therein, was a stainless steel plate of 0.2 mm thick. In connection with the support, was a standard printing plate for the printing press, being 800 mm long (in the printing direction)×1030 mm wide. The support was 800 mm long in the printing direction, equal to the standard printing plate of the printing press, and 1046 mm wide. The width of the substrate was slightly wider than that of the standard printing plate in order to secure a space for forming the protruded pieces.

A series of attaching holes each having the diameter of 4.5 mm was formed in and along both ends of the stainless steel, and properly cut. Those attaching holes were provided at substantially the same interval as the engaging holes of the printing plate. Three stainless steel plates were formed of which the series of attaching holes were aligned at different pitches P, 26.6 mm ($6.08\times10^3\times D/W$) 17.7 mm ($4.06\times10^3\times D/W$), and 9 mm (2D).

Pins made of stainless steel were bonded, by epoxy adhesive, on the series of attaching holes of the stainless steel plate or sheet. The diameter of each of the pins was 4.5 mm, and the height of it after it was bonded was 2 mm.

Thus, the metal plates having the series of attaching holes were manufactured, like the example of packing sheets. The protruded pieces of the metal plates were positioned so as not to interfere with the various plate cylinders, the rubber cylinder, inking roller, wetting roller and the like, when the metal plates are wound on the plate cylinder.

A printing plate was cut to have the following dimensions: the length of it when viewed in the printing direction was 780 mm, slightly shorter than that of the standard printing plate (i.e., 800 mm) for the above printing press, and the width of it was 1046 mm, slightly wider than that of the standard printing plate (i.e., 1030 mm) in order to secure the space for forming the series of engaging holes at and along both ends thereof.

A series of engaging holes each having the diameter of 4.5 mm was formed in and along both ends of the printing plate when viewed in the widthwise direction. Three printing plates were formed of which the series of engaging holes were aligned at different pitches P, 26.6 mm ($6.08\times10^3\times D/W$), and 17.7 mm ($4.06\times10^3\times D/W$), and 9 mm (2D), so that the engaging holes printing plates match in pitch the protruded pieces series of the metal plates.

The exposure, plate-forming, printing and evaluations of the resultant prints were carried out as in the procedure of Examples 1 and 2. The results are tabulated in Table 3.

TABLE 3

| Sample No. | Pitch (mm) (engaging hole/ protruded piece) | | Evaluation of Mis-registration |
|---|---|---|---|
| 1 | 26.6 | $6.08 \times 10^3 \times D/W$ | x |
| 2 | 17.7 | $4.06 \times 10^3 \times D/W$ | Δ |
| 3 | 9 | 2D | ○ |

Printing press: DAIYA 1F (MITSUBISHI HEAVY INDUSTRY corporation)
Printing plate width: 1030 mm
Diameter of each protruded piece: D = 4.5 mm The evaluation of misregistration:

○: ten evaluators all evaluated that no picture quality deterioration arising from misregistration was present.

Δ: seven to eight evaluators evaluated that no picture quality deterioration was present. No problem in practical use.

×: a six or smaller number of evaluators evaluated that no picture quality deterioration was present. The printed pictures were at an impractical level.

The test results show that when the pitch of the engaging holes (protruded pieces) is 17.7 mm ($4.06\times10^3\times D/W$), the misregistration is at a practical level, and a distortion (expansion) of the form plate is effectively reduced, and further that when it is 9 mm (2D), no problem arises in practical use.

From the descriptions thus far made, it is seen that a distortion (expansion) of the form plate is put within a practical use level if the following condition is satisfied:

$$P \leqq 4.06\times10^3\times D/W$$

where

P mm: pitch of the series of engaging holes (protruded pieces)

D mm: diameter of each protruded piece

W mm: width of the printing plate

Incidentally, when the pitch of the engaging holes series (protruded piece series) is shorter than 2D, the strength of the area of the plate material, located between the adjacent engaging holes of the printing plate, is insufficient, and damage of the holes was observed in handling (e.g., carrying) the printing plate.

As seen from the foregoing description, in the printing method of the present invention, a printing material is held with a series of protruded pieces formed on and along the right and left ends of a plate cylinder. Those protruded pieces are aligned at predetermined pitches. Therefore, the plate material is attached to the plate cylinder more reliably, and can sufficiently endure pressure applied in lithographic printing.

Also in the printing method, a plate material is cut and engaging holes are formed in the plate material in a form-plate forming device. The plate material may be cut to have a desired size. Further, in the exposure process, it is easy to align the engaging holes with an exposure image.

Note that in the examples according to the present invention explained above, the packing sheet having a plurality of protruded pieces which is attached to the printing cylinder, is described. The present invention, however, is not limited to this. The protruded pieces having a predetermined interval in the cylindrical direction can be formed by directly machining a printing cylinder having a flat peripheral surface, as shown in FIG. 9. The present invention is based on Japanese Patent Application No. Hei. 10-31493, which is incorporated herein by reference.

While there has been described certain features in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A printing method for performing lithographic printing in multiple colors by use of flexible press plates, said printing method comprising the steps of:

providing a lithographic printing device;

providing said lithographic printing device with plate cylinders, a plate cylinder being provided for each color of said multiple colors, to be printed;

forming each of said plate cylinders with a series of protrusions on an outer peripheral surface of each plate cylinder;

aligning said series of protrusions in a circumferential direction on each said plate cylinder;

providing a plurality of press plates;

forming each of said press plates with a series of engaging holes;

aligning said series of engaging holes of one of said press plates in a printing direction such that said series of protrusions of a respective one of said plate cylinders is insertable into said series of engaging holes;

attaching said one of said press plates to said respective one of said plate cylinders by engaging said protrusions of said one of said plate cylinders with said engaging holes of said one of said press plates; and carrying out said printing, wherein said engaging holes forming step is conducted while a following equation is satisfied:

$$2D \leqq P \leqq 4.06 \times 10^3 \times D/W$$

where P defines at least one of a pitch of the series of engaging holes of said one of said press plates in said printing direction and a pitch of the series of protrusions of said one of said plate cylinders in said circumferential direction, D indicates a diameter of each one of said protrusions, and W denotes a width of said one of said press plates.

2. A printing method according to claim 1, wherein said printing step is conducted while rotating said one of said plate cylinders in a state such that said engaging holes of said one of said press plates are engaged with said protrusions of said respective one of said plate cylinders.

3. The printing method according to claim 1, wherein said lithographic printing device further comprises an exposure drum which has a series of protrusions formed on and along an outer circumferential surface thereof so as to be inserted into said series of engaging holes formed in said one of said press plates, and said printing method further comprises the steps of:

attaching said one of said press plates to said exposure drum by engaging said engaging holes of said one of said press plates with said protrusions of said exposure drum; and exposing said one of said press plates.

4. A printing method for performing lithographic printing in multiple colors by use of flexible press plates, said printing method comprising the steps of:

providing a lithographic printing device;

providing said lithographic printing device with plate cylinders, a plate cylinder being provided for each color of said multiple colors, to be printed;

forming each of said plate cylinders with a series of protrusions on an outer peripheral surface of each plate cylinder;

aligning said series of protrusions in a circumferential direction on each said plate cylinder;

providing a press plate in a form of a roll which is stored in a form-plate forming device;

drawing out said press plate from said roll;

forming said press plate with a series of engaging holes;

aligning said engaging holes of said press plate in a printing direction;

attaching said press plate to one of said plate cylinders by engaging said protrusions of said one of said plate cylinders with said engaging holes of said press plate; and carrying out said printing;

wherein a pitch of the series of engaging holes of said press plate in said printing direction is determined so as to satisfy a following equation:

$$2D \leqq P \leqq 4.06 \times 10^3 \times D/W$$

where P defines at least one of a pitch of the series of engaging holes of said press plate in said printing direction, D indicates a diameter of each one of said protrusions, and W denotes a width of the press plate.

5. The printing method according to claim 4, wherein said lithographic printing device further comprises an exposure drum which has a series of protrusions formed on and along an outer circumferential surface thereof so as to be inserted into said engaging holes of said press plate, and said printing method further comprises the steps of:

attaching said press plate to said exposure drum by engaging said protrusions of said exposure drum with said engaging holes of said press plate; and exposing said press plate.

* * * * *